US005829144A

United States Patent [19]

Dilworth et al.

[11] Patent Number: 5,829,144

[45] Date of Patent: Nov. 3, 1998

[54] KNIFE HOLDER FOR A FOLDING KNIFE

[75] Inventors: Ben Dilworth, Jacksonville, Fla.; Jay Burdick, Oswego, N.Y.

[73] Assignee: Barbarian Tool, Inc., Kings Hill, Virgin Islands (U.S.)

[21] Appl. No.: 889,926

[22] Filed: Jul. 10, 1997

[51] Int. Cl.[6] ..... B26B 1/02

[52] U.S. Cl. ..... 30/158; 30/155; 30/298.4; 224/232

[58] Field of Search ..... 30/151, 155, 158–160, 30/298.4; 224/232; 7/118–120

[56] References Cited

U.S. PATENT DOCUMENTS

| | | | |
|---|---|---|---|
| 1,600,602 | 9/1926 | Schrade | 30/155 |
| 4,426,779 | 1/1984 | Morgan | 30/158 X |
| 4,466,561 | 8/1984 | Slaughter | 30/155 X |
| 4,494,310 | 1/1985 | Slaughter | 30/155 |
| 4,525,928 | 7/1985 | Foster | 30/158 |
| 4,561,577 | 12/1985 | Moore | 224/232 |
| 4,909,424 | 3/1990 | Reynolds | 224/232 |

*Primary Examiner*—Douglas Watts
*Attorney, Agent, or Firm*—Thomas C. Saitta

[57] ABSTRACT

A holder for a folding knife which retains the knife in a folded configuration with blade retention means to maintain the knife blade in a slightly open position so that the knife is opened when it is withdrawn from the holder, where the blade retention means do not contact the sharp edge of the knife.

8 Claims, 4 Drawing Sheets

KNIFE HOLDER FOR A FOLDING KNIFE

BACKGROUND OF THE INVENTION

This invention relates generally to knife holders for a folding knife, and more particularly to holders for folding knives where the blade automatically locks into the full open position and a release means must be actuated to allow the knife to be folded. Even more particularly, the invention relates to such knife holders which automatically cause the knife to open to the locked position by withdrawing the knife from the holder. Even more particularly, the invention relates to such knife holders which do not contact the sharp edge of the blade when the knife is withdrawn from or inserted into the holder, which provide blade guard means to protect the user from the sharp blade edge, which allow the knife to also be withdrawn in the closed position, and which enable the knife to be mounted into the holder in the fully closed position such that removal does not open the knife.

Folding knives, also known as clasp knives or jackknives, are well known and comprise a slotted handle and a sharpened blade mounted onto a pivoting hinge so that the sharp edge of the blade can be folded into the handle. The jackknife or locking blade type of folding knife further comprises a locking mechanism which automatically locks the blade in the full open position. To fold the blade into the handle, a release means such as a button or locking arm must be actuated to allow movement of the blade relative to the handle. Folding knives have two easily apparent advantages over straight or non-folding knives—the primary advantage being directed toward safety in that the sharp blade of the knife is contained within the housing when folded and is not likely to cause accidental injury during handling, and another advantage being that the knife occupies less space when folded and is therefore easier to carry and store. The disadvantage of a folding knife over a straight knife is that the folding knife must be unfolded each time the knife is to be used and folded each time it is to be stored. This takes additional time compared to simply pulling a straight knife from a scabbard or sheath holder. Unfolding the folding knife requires a two-handed physical operation and there are numerous circumstances where the knife may be needed where both hands are not immediately available. The user must grasp the handle in one hand and use the thumb or fingers of the other hand to grasp and pivot the blade to the open position. These problems have been previously noticed, and devices have been developed to address them in various manner.

For example, U.S. Pat. No. 4,426,779 to Morgan shows a generally C-shaped holder having an open slot to receive the blade of the folding knife. The blade is inserted into the slot and the sharp edge is abutted against a detent means, described as a pin or a roller, with the knife handle being pivoted against the opposite side of the detent to fit within the two broad arms of the holder. The detent keeps the blade from fully closing into the knife handle. The knife is removed by pivoting the end of the handle away from the holder, the detent acting as a fulcrum holding the blade in place to provide the leverage for the handle to be pivoted to the full open position. To insert the knife into the holder, the knife must be partially folded before insertion, as there is no detent or wall to provide a fulcrum against which to pivot the handle closed. In addition to this drawback, the primary shortcoming of this design is that the sharp edge of the knife contacts the detent member, meaning that the blade will be dulled every time it is withdrawn and inserted. Morgan realizes this failing, but addresses it by providing a knife sharpening member as the detent, a very impractical attempt to solve the problem since instead of removing the cause Morgan provides means to resharpen the knife after it is dulled. A knife holder shown in U.S. Pat. No. 4,600,133 to Maihos is similar in design and suffers from the same problem whereby the detent pin or post for opening the knife abuts the sharp edge of the blade. Maihos does improve on the concept by providing a second detent against which the back of the blade is pressed to close the knife during insertion.

Foster in U.S. Pat. No. 4,525,928 avoids the problem of abutting the sharp edge of the blade by a detent member by providing protuberances which snap into the thumb slit or notch in the blade after the blade is inserted and the handle closed. The problem with this design is that the knife blade must be provided with non-standard slots which extend completely to the back edge of the blade. The holder cannot be used with standard knives having short thumb notches which terminate prior to the blade edge. U.S. Pat. No. 4,909,424 to Reynolds shows a knife holder which comprises a pivoting blade sheath to receive the tip of the blade. This design also suffers from the fact that the sharp blade edge contacts a portion of the holder, meaning that the blade is dulled or the holder is sliced every time the knife is withdrawn or inserted.

A better construction for the detent means in an automatic knife opener holder is shown in U.S. Pat. No. 4,494,310 to Slaughter. Here the detent means to retain the blade during closure and opening is formed by a pair of flanges extending a short distance into the blade receiving slot, the two flanges creating a narrow groove which allows the sharp edge of the knife blade to pass through but is sufficiently narrow to retain the wider portion of the blade. These flanges provide the fulcrum for leveraging the knife to close or open. The back of the blade slot is solid and provides the stop to restrain the blade during the closing operation. The major problem of the Slaughter device, a problem shared by the other knife holders, is that the sharp edge of the blade is fully exposed during the opening and closing operations, meaning that the user must be extremely careful and alert that he does not touch the sharp blade edge or that his hand not slip. Another problem with the Slaughter design is that the knife cannot be removed from the holder in the closed position.

It is an object of this invention to provide a knife holder for a folding knife which automatically opens the knife to the fully open and locked position when the knife is withdrawn from the holder which improves on the designs heretofore known. This object is accomplished by providing such a knife holder where the sharp edge of the blade is not contacted during any part of the insertion or withdrawal operation, where the knife can be removed from the holder in the fully closed position as well as in the fully opened position, where the sharp blade edge remains positioned within blade guard members of the holder during the opening operation until the knife is fully open and during the closing operation as well to protect the user from injury, and where the knife can be stored in the holder in the fully closed position such that withdrawal does not automatically open the knife. These and other objects, apparent from the disclosure herein, are accomplished by providing a knife holder where the blade retention means comprise converging members which form a narrow slot at one end of the holder to grip the blade below the sharp edge and where the sides of the holder extend beyond the sharp blade edge to form blade guard members with a deep recess to receive the blade in a safe manner and to encase and retain the handle within the holder.

SUMMARY OF THE INVENTION

The invention is a holder for a folding knife, designed to be worn on a belt, which automatically opens the folded knife to the fully open position upon withdrawal of the knife from the holder. The holder also allows the knife to be inserted and folded back into the holder in a single motion. The holder is compatible with any type folding knife, such as a clasp knife or jackknife, and is particularly suitable for use with folding knives which lock in the fully open position. The holder is designed such that the sharp edge of the blade is never in contact with any component of the holder, such that the edge will not be dulled or blunted due to insertion or withdrawal from the holder. The holder allows the knife to be removed without opening the blade if desired. The holder also provides a blade recess area within the body of the holder such that the sharp edge of the blade does not extend beyond the holder to prevent accidental injury during removal or insertion. The holder also allows the knife to be stored within the holder in a fully closed, passive position such that the blade will not be opened upon withdrawal of the knife from the holder The holder comprises an access end and a fulcrum end to retain the knife therebetween, with the access end providing a recess area for the user to grasp the knife handle to remove the knife from the holder and the fulcrum end providing fulcrum or leveraging means to pivot the knife between the open and closed positions. Blade retention means within the body of the holder and in the blade recess area comprise a pair of generally aligned longitudinal members which define a relatively large insertion slot to receive the sharp blade edge and a portion of the blade body. The longitudinal members converge to form a narrow slot relative to the insertion slot at the access end of the holder, such that the sharp blade edge will pass through the narrow slot but the blade body will be too wide and thereby retained by the blade retention members when the blade is slid toward the access end. A pair of blade guard members extend on each side of the holder to a point farther beyond the sharp edge of the knife blade, such that when the blade is inserted into the blade retention members the sharp blade edge will remain positioned within a blade recess area defined by the blade guard members to prevent accidental injury during insertion or removal. The blade guard members further act to retain the folded knife within the holder, either through handle detent members which retain the handle by friction or by virtue of being separated by a distance slightly smaller than the thickness of the knife handle or by virtue of the blade guard members themselves retaining an extended pin or rivet on the knife handle.

DETAILED DESCRIPTION OF THE INVENTION

Figure 1:
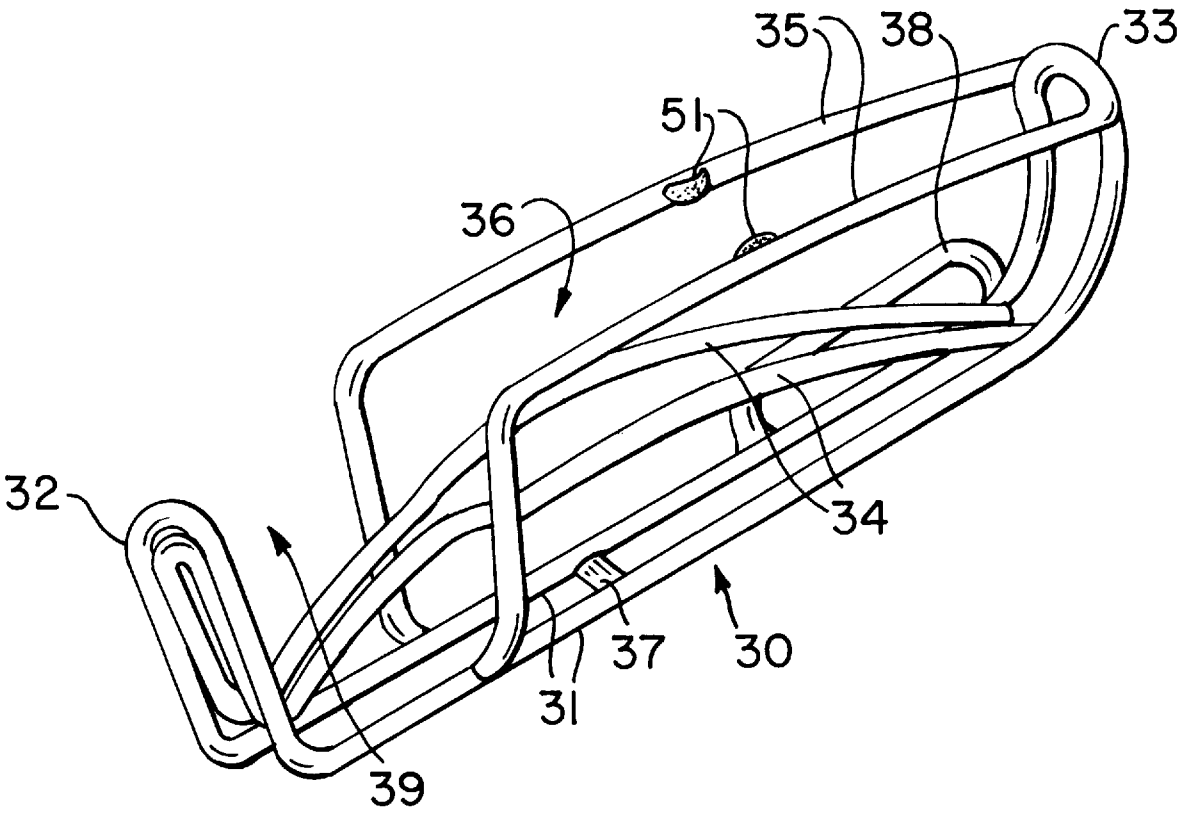
FIG. 1 is a perspective view of the device.

With reference to the drawings, the invention will now be described in detail with regard to the best mode and preferred embodiment. The invention is designed for use in combination with a folding knife 10 which comprises a handle 11 and a blade 12. The blade 12 has a body or shank 13, a dull back edge 16, a sharp cutting edge 14 and a tip 15. The blade 12 is attached to the handle 11 by a blade pivot pin 21, such that the sharp edge 14 can be folded into a recess within the handle 11. In certain folding knives 10, the blade 12 automatically locks into the fully open position to become a rigid device, the knife 10 having locking means 17 which is biased to snap into the locking mode when the blade 10 is fully open. In a typical construction, the locking means 17 is an extended bar which pivots about a generally centrally located locking means pivot pin 18. To unlock the blade 10 from the fully open position, the locking means 17 is depressed at the release recess 19 mounted at the free end of the handle 11. Such knives 10 are well known in the art.

Figure 2:
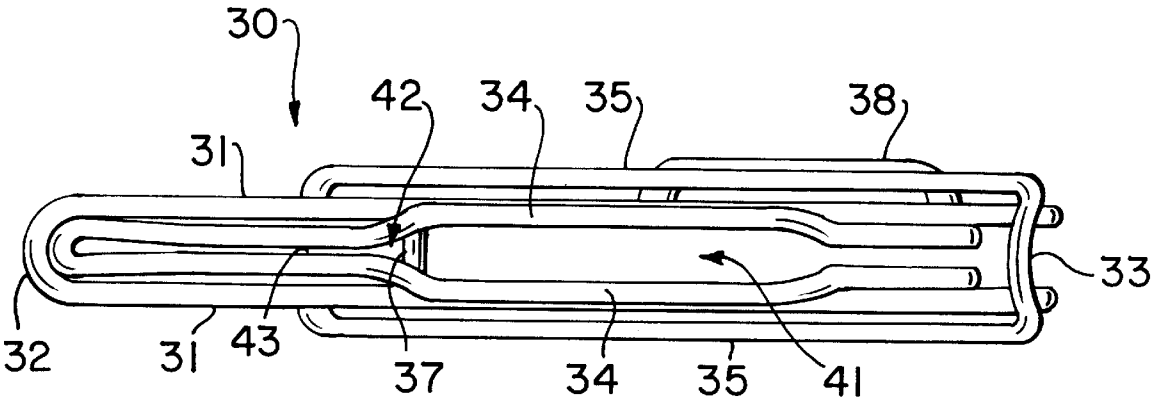
FIG. 2 is a view of the device as seen from the knife receiving side.

Referring now to FIGS. 1 and 2, the holder 30 is seen to comprise in general a pair of base members 31, a pair of blade retention members 34 and a pair of blade guard members 35. As shown in the figures, the holder 30 is preferably formed of metal rods joined by welding or other suitable methods to create the structure, but the holder 30 can be formed of similar materials with different cross-sectional shapes without departing from the crux of the invention. The holder 30 can also be formed with solid side panels of plastic or other suitable materials. The two base members 31 are generally parallel and are connected at each end to an access end member 32 and a fulcrum end member 33, which may be formed by upturning the or bending the end portions of the base members 31. As shown, the rods forming the base members 31, access end member 32 and fulcrum end member 33 can be part of an unbroken loop. The transition from the base members 31 to the fulcrum end member 33 is preferably somewhat rounded or curved, and the fulcrum end member 33 preferably widens somewhat.

Figure 6:
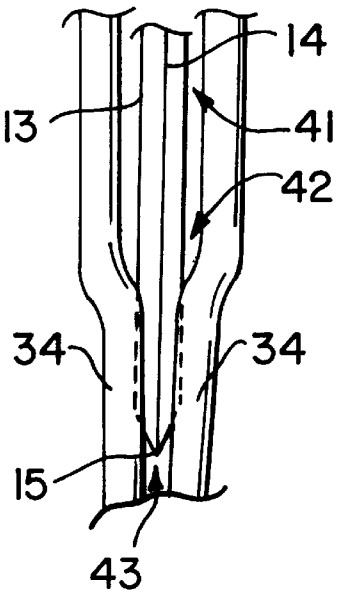
FIG. 6 is a partial view showing the narrow retention slot of the blade retention members with a knife blade inserted therebetween.

A pair of blade retention members 34 are attached to the base members 31, preferably at or adjacent the junction of the fulcrum end member 33 and the junction of the access end member 32. The blade retention members 34 are preferably curved or arched away from the base members 31 into the interior of the holder 30, extending the greatest distance from the base members 31 in the middle portion of the holder 30. The blade retention members 31 are generally parallel over the majority of the central portion of the holder 30 and are separated a distance significantly wider than the thickness of blade body 13 to define an insertion slot 41. Insertion slot 41 is of sufficient width to allow the blade tip 15, the sharp blade edge 14 and a portion of the blade body 13 to easily pass between the two blade retention members 34 in this area. The insertion slot 41 is bordered toward the access end 32 of the holder 30 by a converging portion 42 defined by the blade retention members 34 being angled toward each other, thus narrowing the distance between the two blade retention members 34, as seen in detail in FIG. 6. The blade retention members 34 are then again configured generally parallel to each other, such that a relatively narrow retention slot 43 is defined by the two blade retention members 34. The retention slot 43 is much narrower than the blade insertion slot 41, and is wide enough to allow the sharp blade edge 14 to protrude between the two blade retention members 34 without contact, but sufficiently narrow such that the blade body 13 cannot pass in between. Thus the blade 12 cannot be removed from the retention slot 43 area unless it is withdrawn longitudinally.

A pair of blade guard members 35 are attached near the access end 32 of the base members 31 adjacent the retention slot 43 and are attached to the fulcrum end member 33. The combination of the blade guard members 35, fulcrum end member 33 and a significant portion of the base members 31 define the encasing portion of the holder 30. The blade guard members 35 extend to the outside of the blade retention members 34 and extend from the base members 31 a distance sufficient to extend beyond the width of a knife blade 12, the width being defined herein as the distance between the sharp edge 14 and the back edge 16, and preferably to a distance sufficient to retain the knife handle 11 between the two blade guard members 35. In this manner the two blade guard members 35 define a relatively deep blade recess area 36.

An insertion stop member 37, being a short post attached generally perpendicularly between the two base members 31 generally adjacent the junction between the converging portion 42 and insertion slot 41 of blade retention members 34, is provided to prevent the blade 12 from passing between base members 31 when the blade 12 is inserted into the holder 30. For folding knives 10 without locking means pivot pins 18 which extend outward from the sides of handle 11, the blade guard members 35 are provided with handle detents 51, as shown in FIG. 1. To mount the holder 30 on a belt, a belt attachment member 38, such as a short looped segment, is attached to one of the base members 31.

Figure 3:
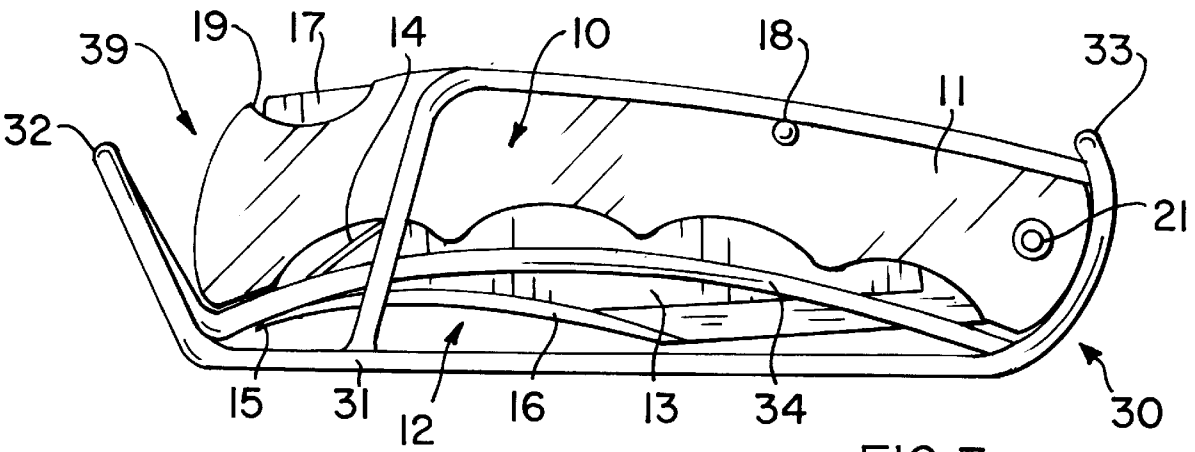
FIG. 3 is a side view showing a knife in the folded position retained by the holder.

For automatic opening of the folding knife 10 upon removal of the knife 10 from the holder 30, the knife is stored in the configuration shown in FIG. 3. The blade tip 15 has been passed through the insertion slot 41 to rest between the blade retention members 34 and the base members 31. The forward portion of the sharp blade edge 14 extends through the retention slot 43 in the blade retention members 31. Because the retention slot 43 of the blade retention members 31 is too narrow to allow passage of the blade body 13 itself, the blade 12 is prevented from biasing fully into the handle 11, as would occur if there were no detent means to prevent it. In other words, the knife 10 is held in the slightly open position. The handle 11 resides in the holder 30, occupying the blade recess area defined by the blade guard members 35 and extending from the fulcrum end 33 to the access end 32. The access end member 32 and the blade guard members 35 define an access recess area 39. The folded knife 10 is securely retained in the holder 30 by the blade guard members 35. For a knife 10 having extended locking means pivot pins 18, the blade guard members 35 are separated a distance equal to the distance across the handle 11, such that the locking means pivot pins 18 must be forced into the blade recess area 36, the blade guard members 35 flexing outward as the locking means pivot pins 18 pass and then resuming their non-flexed separation distance, thereby trapping the handle 11 within the holder 30. For a knife with no extended pins 18, the blade guard members 35 are provided with at least one handle detent 51 which extends inward between the blade guard members 35. In similar manner, the handle detent 51 will flex outward when the handle 11 is inserted into the holder 30, with the blade guard members 35 resuming their normal separation distance to retain the handle 11.

Figure 4:
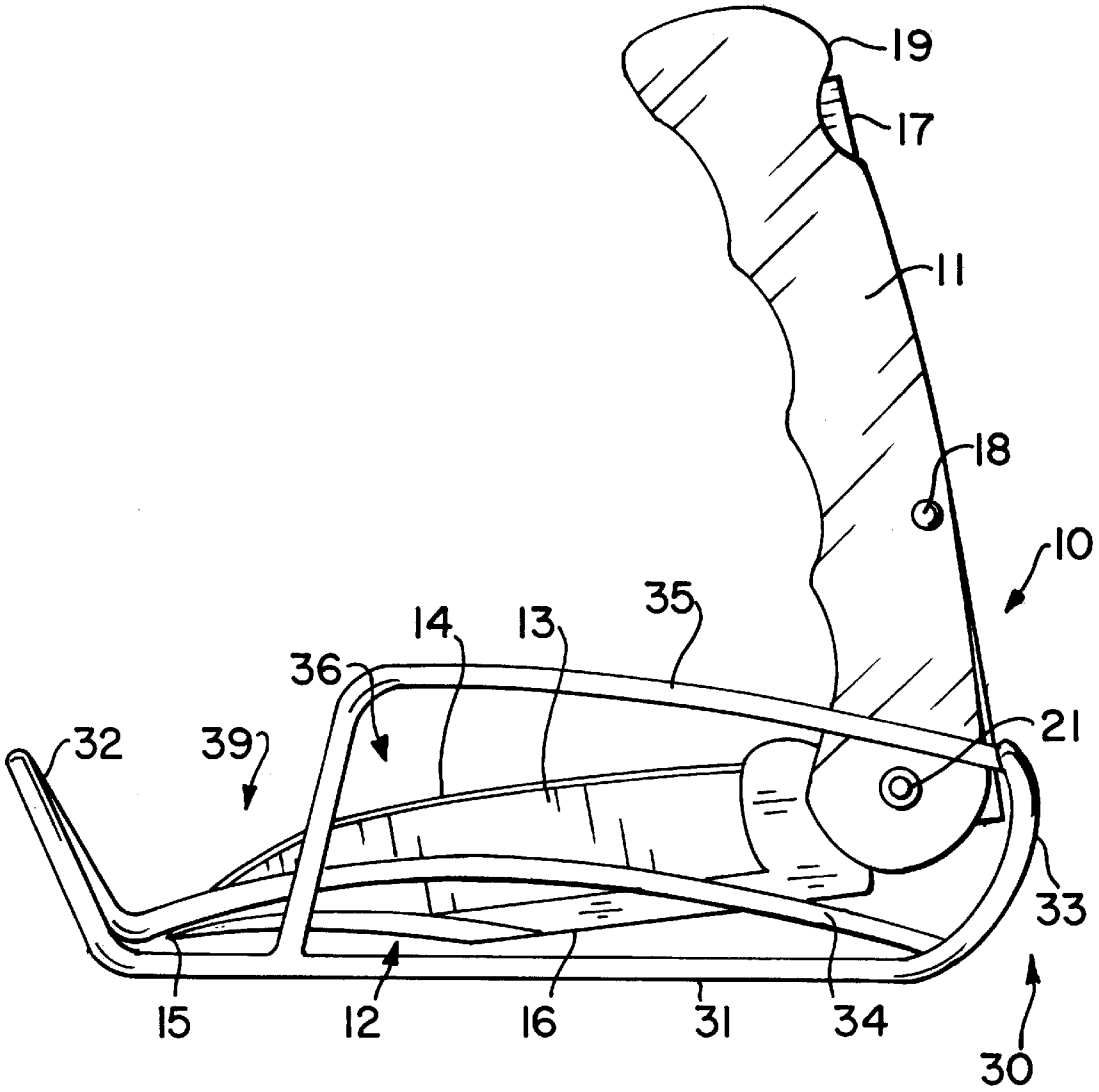
FIG. 4 is a side view showing the knife in the partially folded position during removal of the knife from the holder.
Figure 5:
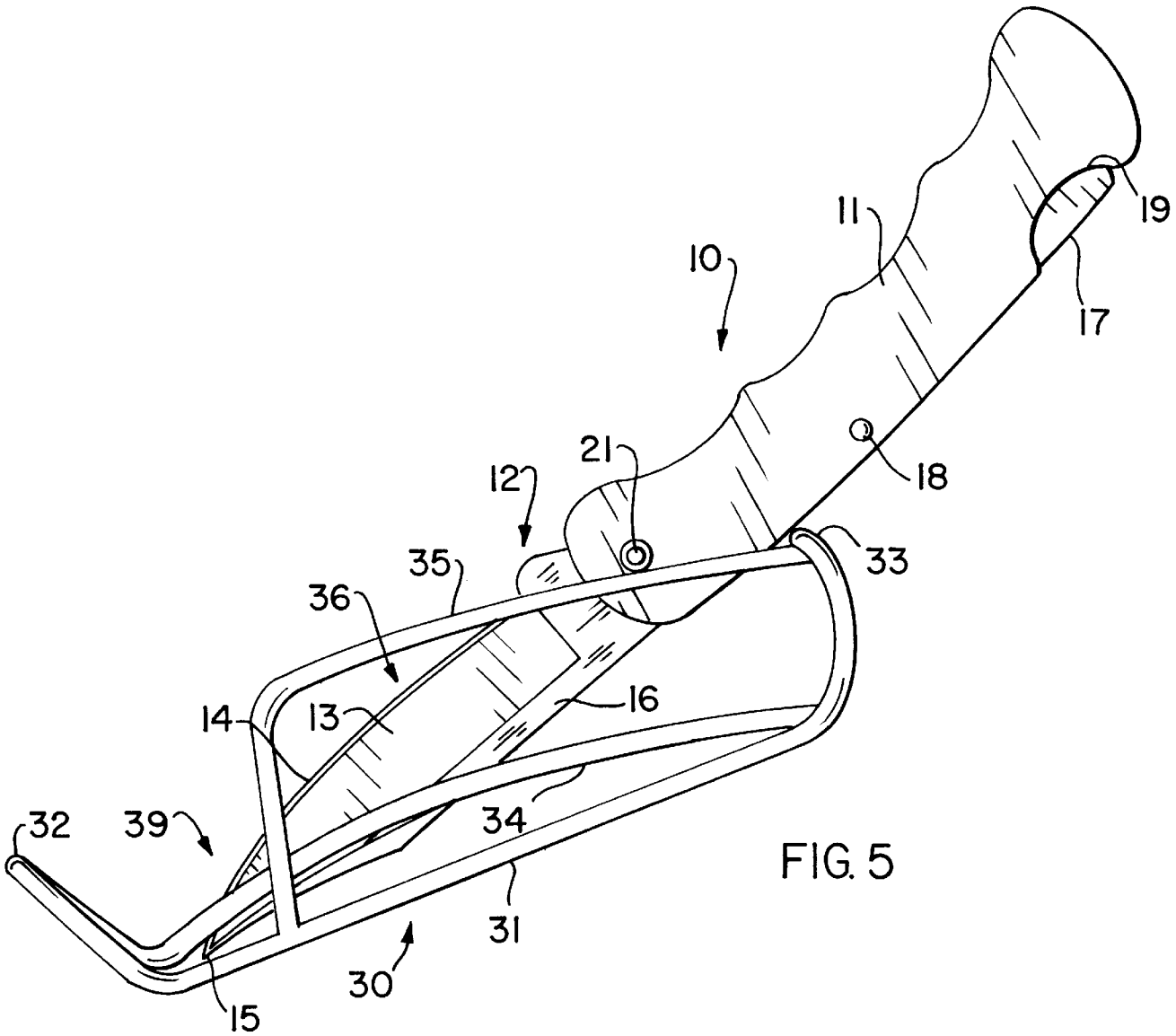
FIG. 5 is a side view showing the knife in the fully open and locked positioned during removal of the knife from the holder.

To remove the knife 10 in the fully open position, the user grasps the handle 11 in the access recess area 39 and pulls the handle 11 away from the base members 31 with sufficient force to pass it between the blade guard members 35. As the handle 11 is pulled, it pivots about the blade pivot pin 21, as shown in FIG. 4, and the knife 10 begins to open since the blade 12 is retained in the holder 30 by retention slot 43 of blade retention members 34. Because the sharp blade edge 14 remains in the retention slot 43 between the blade retention members 34, the sharp edge 14 makes no contact with the holder 30. As the handle 11 approaches approximately 90 degrees relative to the blade 12, the back of the handle 11 abuts the fulcrum end member 33. The fulcrum end member 33 provides a fulcrum for leveraging the handle 11, and at this point the blade 12 is pushed slightly toward the access end 32. The sharp blade edge 14 remains in the retention slot 43 so that it is not dulled by this action either. The handle 11 rocks onto the fulcrum end member 33 as it passes from 90 degrees to the fully opened, approximately 180 degree position shown in FIG. 5. The blade 12 then locks into the open position, and the knife 10 is removed from the holder 30 by withdrawing it generally longitudinally relative to the holder 30, such that the blade tip 15 is pulled beyond the retention slot 43 and into the insertion slot 41, where the blade body 13 no longer restrained by the blade retention members 34. Until the blade 12 is locked into position and removed from the holder 30, the sharp edge 14 remains positioned within the blade recess area 36 formed by the blade guard members 35, thereby preventing accidental injury to the user during the removal operation.

Insertion of the knife 10 into the holder 30 is essentially the opposite operation. The locking means 17 is released to allow the blade 12 to fold about the blade pivot pin 21. The blade 12 is inserted between the blade guard members 35 into the blade recess area 36 and through the insertion slot 41 between the blade retention members 34 until the back edge 16 contacts the insertion stop member 37. At this point the sharp edge 14 is again positioned within the blade recess area 36 defined by the blade guard members 35, such that the sharp edge 14 is not exposed as the knife 10 is folded. The insertion stop member 37 provides the detent means to allow the handle 11 to be folded into the holder 30. As the user folds the knife 10, the blade tip 15 and sharp edge 14 slide forward into the retention slot 43, the sharp edge 14 not contacting any portion of the holder 30. As the handle 11 is folded past the 90 degree position relative to the blade 12, the pivoting end slips over the fulcrum end member 33 and between the blade guard members 35 to abut the interior of the fulcrum end member 33 and the attachment area of the blade retention members 34. The combination of these components retains the handle 11 and allows it to be folded to closure with the handle fully retained within the blade guard members 35 and access end member 32. The knife 10 is now securely retained within holder 30, ready to be removed in the open position when needed.

Because of the unique design of the holder 30, it is also possible to remove the knife 10 from the holder 30 in the closed position. To accomplish this, the user grasps the handle 11 at the access recess area 39 as before and pivots the handle 11 a short distance to release it from the blade guard members 35. At this point, rather than continuing to pivot the handle 11 back toward and against the fulcrum end member 33, the user pulls the handle in the direction of the access end member 32 and removes the pivoting end of the knife 11 from the holder 30. The handle is then slid longitudinally toward the fulcrum end 33 to withdraw the blade tip 15 from the retention slot 43. When the tip 15 clears the retention slot 43 into the wider insertion slot 41, the spring bias in the knife 10 causes the blade 12 to fold completely into the handle 11.

Alternatively, the holder 30 can be used to retain the knife 10 in the fully closed position such that removal of the knife 10 from the holder 30 does not automatically open the blade 12. The knife 10 in the closed configuration can be inserted directly into the holder 30 with the back edge 16 of the blade 12 passing through the insertion slot 41 but above the portion of the blade retention members 34 forming the retention slot 43. As before, blade guard members 35 secure the knife 10 within the holder 30 by retaining the locking means pivot pins 18 or by action of the handle detents 51 against the handle 11.

It is contemplated that equivalents and substitutions for certain elements or components described above may be obvious to those skilled in the art, and the disclosure above is intended to encompass such equivalents. The true scope and definition of the invention therefore is to be as set forth in the following claims.

We claim:

1. A knife holder for a folding knife, the holder comprising a pair of generally parallel base members joined to a fulcrum end member and an access end member, a pair of blade retention members joined to said base members and a pair of blade guard members joined to said fulcrum end member and said base members, said pair of base members and said pair of blade guard members together defining a blade recess area to receive a handle of a folding knife, said pair of blade retention members having a relatively wide portion defining an insertion slot, a converging portion, and a relatively narrow portion defining a retention slot, where said pair of blade retention members retain a blade of a folding knife having a sharp edge in a slightly open position without contacting the sharp edge when the handle is folded into said blade recess area.

2. The holder of claim 1, where said pair of blade guard members are shorter than said base members and define an access recess area in combination with said access end member to allow a folded knife handle to be gripped for removal from said knife holder.

3. The holder of claim 1, where said pair of blade retention members are curved.

4. The holder of claim 1, further comprising an insertion stop member attached to said pair of base members to provide a detent means to abut a back edge of a knife blade inserted into said holder.

5. A knife holder and folding knife in combination, said folding knife having a handle and a blade, said blade having a tip, a sharp edge, a body and a back edge, said holder comprising a pair of generally parallel base members joined to a fulcrum end member, a pair of blade retention members joined to said base members and a pair of blade guard members joined to said fulcrum end member and said base members, said pair of base members and said pair of blade guard members together defining a blade recess area to receive said handle of said folding knife, said pair of blade retention members having a relatively wide portion defining an insertion slot which is wider than said body of said blade, a converging portion, and a relatively narrow portion defining a retention slot which is wider than said sharp edge of said blade and narrower than said body of said blade, where said pair of blade retention members retain said blade of said folding knife in a slightly open position without contacting said sharp edge when said blade and handle are inserted into said knife holder.

6. The combination of claim 5, where said pair of blade guard members are shorter than said handle and define an access recess area to allow said handle to be gripped for removal from said knife holder.

7. The combination of claim 5, where said pair of blade retention members are curved.

8. The combination of claim 5, further comprising an insertion stop member attached to said pair of base members to provide detent means to abut said back edge of said knife when said knife is inserted into said holder.

* * * * *